United States Patent [19]

Eheim

[11] 4,387,688

[45] Jun. 14, 1983

[54] FUEL INJECTION PUMP FOR INTERNAL COMBUSTION ENGINES

[75] Inventor: Franz Eheim, Stuttgart, Fed. Rep. of Germany

[73] Assignee: Robert Bosch GmbH, Stuttgart, Fed. Rep. of Germany

[21] Appl. No.: 409,248

[22] Filed: Aug. 18, 1982

Related U.S. Application Data

[63] Continuation of Ser. No. 124,886, Feb. 26, 1980, abandoned.

[30] Foreign Application Priority Data

Mar. 10, 1979 [DE] Fed. Rep. of Germany ..... 2909559

[51] Int. Cl.[3] ..... F02D 1/06

[52] U.S. Cl. ..... 123/502; 123/179 L

[58] Field of Search ..... 123/502, 179 L, 366, 123/368, 501, 500, 373; 417/462

[56] References Cited

U.S. PATENT DOCUMENTS

| | | | |
|---|---|---|---|
| Re. 25,012 | 7/1961 | Dressler | 123/366 |
| 4,177,775 | 12/1979 | Hofer | 123/179 L |
| 4,345,566 | 8/1982 | Hammock | 123/179 L |

FOREIGN PATENT DOCUMENTS

| | | | |
|---|---|---|---|
| 2345724 | 3/1974 | Fed. Rep. of Germany | 123/502 |
| 2068591 | 8/1981 | United Kingdom | 123/501 |

*Primary Examiner*—Charles J. Myhre
*Assistant Examiner*—Carl Stuart Miller
*Attorney, Agent, or Firm*—Edwin E. Greigg

[57] ABSTRACT

A fuel injection pump is proposed wherein the idling rpm is influenced with the injection time adjustment via a linkage. The increased starting quantity can also be controlled along with this via an additional apparatus. The adjustment can be made in particular in accordance with engine temperature via a thermostatic servomotor.

11 Claims, 4 Drawing Figures

FUEL INJECTION PUMP FOR INTERNAL COMBUSTION ENGINES

This is a continuation of application Ser. No. 124,886, filed Feb. 26, 1980 now abandoned.

BACKGROUND OF THE INVENTION

The invention relates to a fuel injection pump of the general type described herein. In a known fuel injection pump of this type, there is a coupling via a cable line between the features A, a cam drive that effects the supply movement of at least one pump piston and B an rpm governor requiring a fuel control member which determines the injection quantity. Not only is a cable line coupling relatively expensive, but it is also difficult to adjust. The degrees of freedom which are desired in such a coupling can be maintained with difficulty or only under some circumstances. What is critical in this problem is the required individual displacement and adjustment of features A and B, by way of which engine characteristics are processed in an extremely critical fashion.

OBJECT AND SUMMARY OF THE INVENTION

The fuel injection pump according to the invention and having the characteristics set forth herein has the advantage over the prior art of overcoming these difficulties in a simple, cost-favorable manner and with a very high degree of freedom of adjustment. The characteristics disclosed represent further substantial advantages of the invention.

The invention will be better understood and further objects and advantages thereof become more apparent from the ensuing detailed description of a preferred embodiment taken in conjunction with the drawings.

DESCRIPTION OF THE PREFERRED EMBODIMENT

Figure 1:
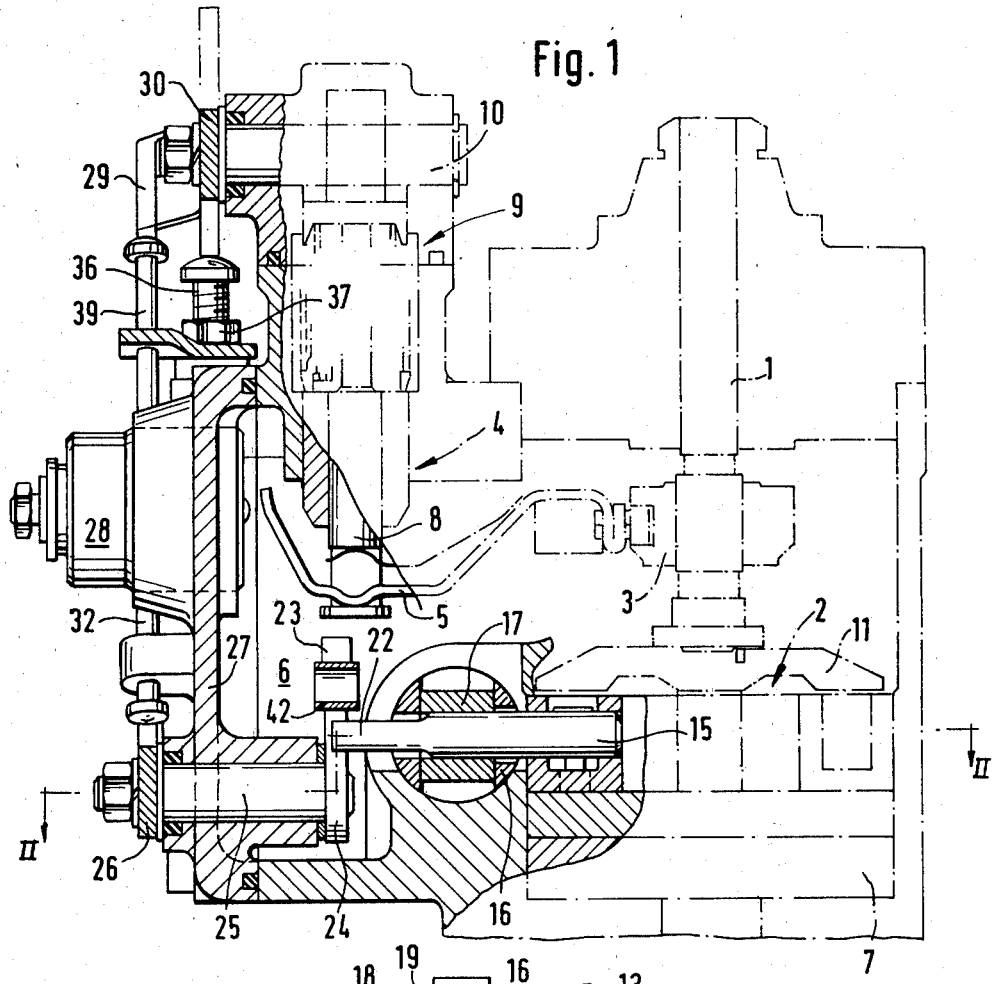
FIG. 1 shows the first embodiment of the invention partially in schematic form and partially in cross-section.
Figure 2:
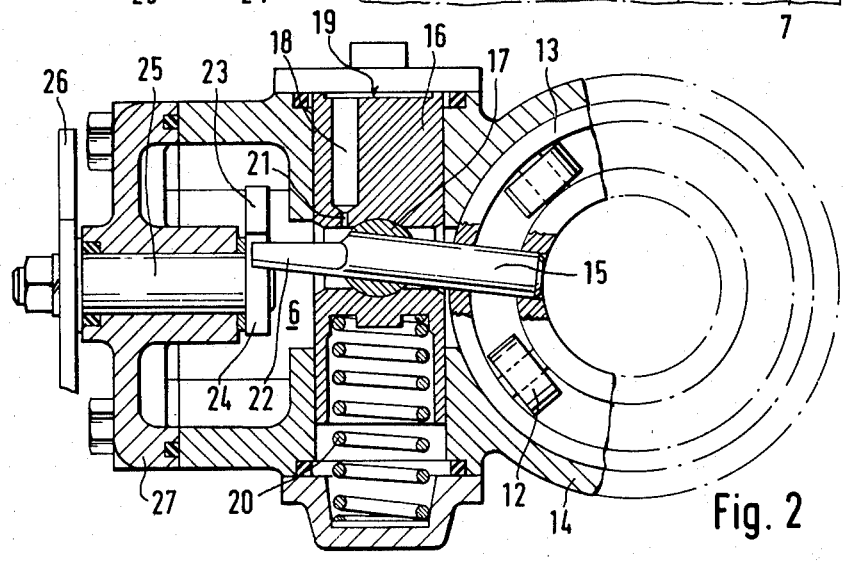
FIG. 2 is a cross-sectional view on line II—II of FIG. 1.

In the exemplary embodiment of a distributor injection pump shown, a pump piston 1, indicated only schematically, is set into simultaneous reciprocal and rotary motion by a cam driver 2, which is also shown only schematically. The fuel injection quantity is controlled by way of an annular slide 3 which surrounds the pump piston 1, with the aid of a hydraulic governor 4 which is coupled with the annular slide 3 via a governor lever 5. An rpm-dependent pressure is generated in the suction chamber 6 of the distributor injection pump via a supply pump 7, which is not shown in further detail and which is driven at pump rpm. This rpm-dependent pressure is exerted upon an adjusting piston aid of the hydraulic governor and displaces this piston counter to the force of a spring unit 9, the tension of which is arbitralily variable via a gear 10.

A cam drive 2 has a cam disk 11 driven with the pump piston 1. The cam disc 11 rolls on the rollers 12 and as a result sets the pump piston into reciprocal motion. The rollers 12 are supported in a roller ring 13 which, being supported in the housing 14 of the injection pump, is rotatable about a certain angle. Depending upon the extent to which the roller ring 13 is rotated in the housing 14, the earlier or the later will begin the particular compression stroke of the pump piston 1, because the cams of the cam ring 11 come correspondly earlier or later into contact with the rollers 12.

The roller ring 13 is firmly connected with a stem 15 which is articulated via a bearing 17 by means of an adjusting piston 16 for adjusting injection. The fuel, pressure which is controlled in accordance with rpm, proceeds from the suction chamber 6 via a bore 18 disposed in the adjusting piston 16 and to the end face 19 thereof and in accordance with the pressure displaces the adjusting piston 16 against a restoring spring 20. In order to damp certain influences by means of varying the pressure, a throttle 21 is disposed in the bore 18. The higher the rpm, the higher the pressure and thus the more the adjusting piston 16 is displaced against the spring 20. Conventionally, this action is intended to attain an adjustment of the injection time toward "early", which depends on the rotary direction of the pump. As a result of the adjustment toward "early" the fuel has sufficient time at higher rpm levels for preparation.

In accordance with the invention, the stem 15 is extended beyond the bearing 17 by means of an extension 22 which cooperates with a stop 23. In the exemplary embodiments, the stop 23, as needed, determines the path of the extended element 22, and thus the onset of injection is adjusted toward "late". That is, the initial position of the injection onset adjustment toward "early" is determinable by means of the stop 23. For instance, when the engine is cold and up to the time when it is warm, a temporary adjustment toward "early" is made via the stop 23, particularly during starting.

In the exemplary embodiment shown in FIGS. 1–4, the stop 23 is disposed on lever 24 which is adjustable from outside the pump housing 14 via a shaft 25 and intervention lever 26. The shaft 25 is supported in a housing cover 27, and when the cover 27 is removed from the housing 14, the lever 24, supported on the inside, is also removed. An adjusting magnet 28 is also disposed in this cover 27, by means of which the annular slide 3 is displaceable to "zero supply quantity" by means of an adjustment at the governor lever 5. In the intervention plane of the lever 26, there is also a coupler lever 29, which is firmly connected with the adjusting lever 30 of the injection pump. The adjusting pump **30*a*, and thus the coupler lever 29 as well, are secured on a shaft 31 which engages the gear 10 of the rpm governor. A coupler rod 32 is disposed between the ends of the levers 26 and 29 and it is variable in its total length via a turnbuckle 33. The coupler rod 32 is supported in an eye 34 disposed on the cover 27 and in a bore of a sheet-metal tongue 35, which is secured by means of screws 36 and lock nuts 37 disposed thereon on the cover 27. Between the sheet-metal tongue 35 and the extension nut 33, a spring 38 is disposed about the coupler rod 32, in order to force the coupler rod 32 in a constant contact with the intervention lever 26. Because the coupler rod 32 acts as a stop for the coupler lever 29 and thus, for the adjusting lever 30, an adjustment of the lever 26 varies the initial tension of the spring unit 9 and thus, as needed, varies the position of the annular slide 3 or the rpm of the engine. The terminal portion 39 of the coupler rod 32 here acts as a stop for the coupler lever 29**.

An adjusting apparatus engages the end 40 of the coupler lever 26 remote from the coupler rod 32 via a rod 41, and is preferably controllable in accordance with temperature. However, a so-called choke can also act as the adjusting apparatus, which is arbitrarily adjustable depending upon the temperature of the internal combustion engine. Furthermore, a member which functions in accordance with temperature, such as an expansible-substance governor, can also act as this apparatus, and is preferably controlled by the engine coolant. By means of this apparatus, first the stop 23 of the injection onset adjustment is displaced via the shaft 25, and second the stop 39 of the coupler lever 29 or adjusting lever 30 is displaced via the coupler rod 32. In the view shown in FIG. 4, the lever 29 assumes the position which corresponds to a cold engine. The coupler rod 32 is displaced toward the right, so that the adjusting lever 30 or the coupler lever 29 is displaced relative to the normal working position indicated with dot-dash lines. This displacement, means that the spring unit 9 is initially stressed somewhat more than in the normal working position, via the gear 10. The outset position of the coupler lever 29 on the stop 39 corresponds to the idling rpm, so that with a corresponding rotation, that is, a variation of the initial stress of the spring unit 9, the fuel injection quantity also undergoes a change during idling. An increase in the initial stress causes an increase of the injection quantity during idling, in order in a conventional manner to overcome the larger degree of hysteresis in the cold engine and also to compensate for the higher fuel consumption by the cold engine. As the engine warms up, the portion 40 of the intervention lever 26 is then adjusted toward the right, either by hand via the choke, or automatically via the expansible-substance governor. As a result, the coupler rod 32 is displaced toward the left and the stop 39 offers the adjusting lever 30 the possibility of assuming the position for idling indicated by dot-dash lines. This position, which is adjustable via the extension nut 33, corresponds to a particular idling rpm or idling injection quantity.

The coupler lever 29 is adjusted with the shaft 25 and when the engine is cold, displaces the extended portion 22 of the injection onset adjustment apparatus toward "early". Then, with an increasing engine temperature or with a corresponding adjustment effected by the choke, the coupler lever 29 then yields again in the direction of "late". As a result, in a simple manner, an increase of idling in the cold engine is combined with an adjustment of the onset of injection toward "early" for the cold engine.

Figure 3:
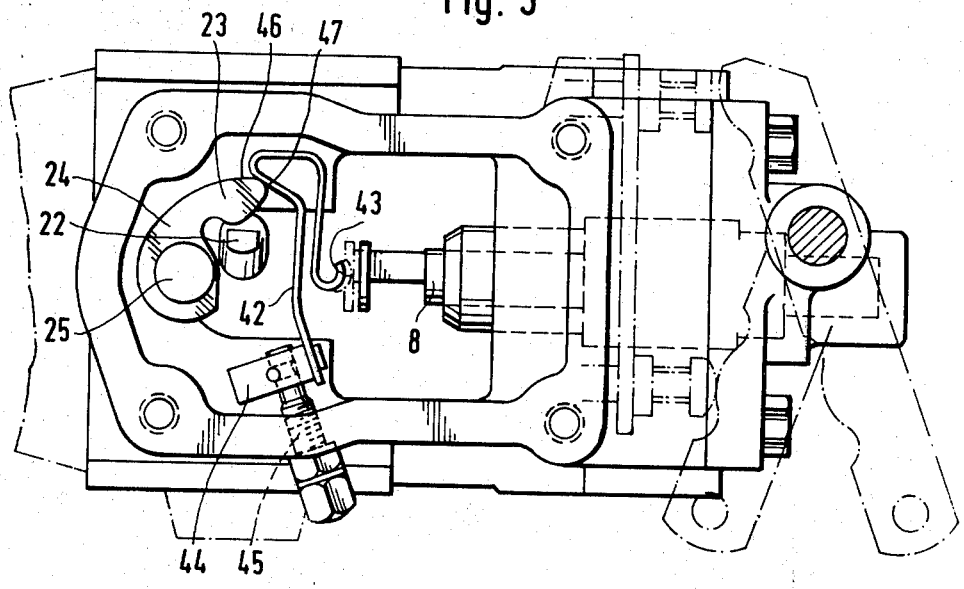
FIG. 3 is an elevational view of the interior of the pump with the cover 27 removed.
Figure 4:
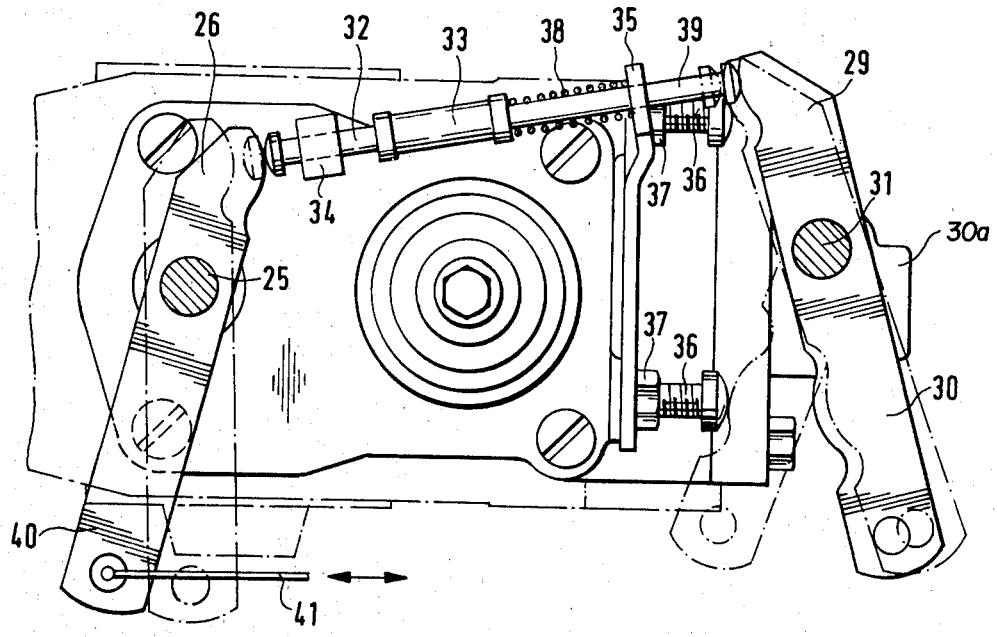
FIG. 4 is an end elevational view of the exterior of the pump looking in the direction of arrow A.

As may be seen particularly in FIG. 3, the described control functions of the fuel injection pump having to do with the cold engine can be supplemented by means of a third function for increasing the injection quantity during starting. During starting, the adjusting piston assumes a lower outset position, which corresponds to an upper outset position of the annular slide 3, in which a maximum fuel quantity is injected. Then, as soon as the engine is idling, the pressure in the suction chamber 6 has increased to such an extent that the adjusting piston 8 of the hydraulic governor 4 assumes an idling position, in which position then only the fuel quantity required for idling is still injected. The position shown in the drawing corresponds to a full-load injection quantity; that is, the adjusting piston 8 assumes a higher position for idling. This given outset position before starting is determined by a stop, which in the illustrated example is a spring 42 made of a bimetallic substance. When the engine or the fuel injection pump is cold, the bimetallic spring 42 assumes the position shown in FIG. 3; when the engine is warm, the stop portion 43 of the spring 42 is displaced into the position indicated by dot-dash lines. The bimetallic spring 42 is disposed on a slotted element 44, which is adjustable from outside the housing via an adjusting screw 45. However, instead of a bimetallic spring, some other temperature-dependent means can be used; in any case, this means is preferably triggered by the coolant temperature of the engine, in order to obtain control in accordance with the actual engine temperature.

The spring 42 however, can also be adjusted by means of a stop 23 of the injection onset control apparatus in order to attain a temperature-dependent adjustment of the stop 43. To this end, the lever 24 has a contour 46 which is arranged to glide on a portion 47 of the spring 42. As a result, with an increasing temperature, that is, when the stop 23 is pivoted toward the left (FIG. 3), the spring 42 or the stop 43 is displaced toward the right in the direction of a smaller increased fuel quantity. If the lever 24 is adjusted via an expansible-substance governor as described above, which is controlled by the engine coolant, then the adjustment of the stop 43 of the adjusting piston 8 corresponds to the engine temperature. In this embodiment, then, the above-described combination of temperature-dependent control of idling and of the onset of injection is combined with the temperature-dependent control of the increased starting quantity. The arrangement of elements in the housing cover 27 or in its general area is particularly advantageous here, as a result of which substantial cost savings can be realized in manufacture, and which assures simple initial adjustment as well as disposition of the pump on the engine.

The foregoing relates to a preferred exemplary embodiment of the invention, it being understood that other embodiments and variants thereof are possible within the spirit and scope of the invention, the latter being defined by the appended claims.

What is desired to be claimed and secured by Letters Patent of the United States is:

1. A fuel injection pump for internal combustion engines comprising (A) a housing, a cam drive in said housing which effects the supply movement of at least one pump piston, said cam drive having a housed rest portion and a revolvable portion, said rest portion being adjustable relative to said revolvable portion to adjust the onset of injection via means responsive at least in accordance with rpm, said means having a stop, and an intervention lever means disposed exteriorly of said housing adapted to cooperate with said stop;

(B) a fuel control member, an rpm governor operating to control said fuel control member which determines injection quantity, an arbitrarily actuatable adjusting lever which varies the rpm of said governor, with an outset position of said governor being determined by means of an adjustable idling stop; and (C) a coupling means between said intervention lever and said adjusting lever;

characterized in that said coupling means includes a displaceable rod supported exteriorly of said housing and a spring surrounding said rod which reacts relative to said rod to force said rod in constant contact with said intervention lever, said spring cooperating with an end of said rod remote from said intervention lever to act as an idling stop for said adjusting lever.

2. A fuel injection pump in accordance with claim 1, characterized in that said rod is variable in its total length via an extension nut.

3. A fuel injection pump in accordance with claim 2, characterized in that said rod and said intervention lever are disposed in one plane and supported on a cover of said housing.

4. A fuel injection pump in accordance with claim 1, characterized in that said stop for the control of the onset of injection is disposed on a lever connected via a shaft with said intervention lever.

5. A fuel injection pump in accordance with claim 4, characterized in that the onset of injection is actuated hydraulically and an adjusting piston is coupled to said rest portion of said cam drive via a stem which traverses said adjusting piston, said stem further including a portion which protrudes outward therefrom.

6. A fuel injection pump in accordance with claim 1, wherein said rpm governor has an adjusting member coupled to a fuel quantity control member, said adjusting member arranged to determine the increased quantity upon starting of the engine, characterized in that said outset position of said adjusting member is determined by the position of said intervention lever.

7. A fuel injection pump in accordance with claim 6, characterized in that said stop means has an arcuate path of travel and is controlled by said intervention lever.

8. A fuel injection pump in accordance with claim 7, characterized in that said stop means in its arcuate path of travel serves to adjust an elastically suspended double-track leaf spring.

9. A fuel injection pump in accordance with claim 8, characterized in that said leaf spring is made of a bimetallic material.

10. A fuel injection pump in accordance with claim 2, characterized in that said intervention lever is adjustable in accordance with the temperature of said engine, in particular by means of an expansible-substance governor controlled by engine coolant.

11. A fuel injection pump in accordance with claim 2, characterized in that said intervention lever is arbitrarily adjustable via a choke.

* * * * *